United States Patent [19]

Rinneburger

[11] Patent Number: 4,929,183

[45] Date of Patent: May 29, 1990

[54] DEVICE FOR ELECTRICALLY INTERCONNECTING ELECTRICAL AND/OR ELECTROMECHANICAL ASSEMBLIES, METHOD OF ELECTRICALLY INTERCONNECTING SUCH ASSEMBLIES, AND APPARATUS MANUFACTURED IN ACCORDANCE WITH THE METHOD

[75] Inventor: Klaus P. K. Rinneburger, Wilnsdorf, Fed. Rep. of Germany

[73] Assignee: U.S. Philips Corporation, New York, N.Y.

[21] Appl. No.: 73,680

[22] Filed: Jul. 14, 1987

[30] Foreign Application Priority Data

Jul. 3, 1986 [DE] Fed. Rep. of Germany ..... 3622355

[51] Int. Cl.[5] ..... H01R 9/09

[52] U.S. Cl. ..... 439/67; 439/77; 439/131; 439/297; 439/374

[58] Field of Search ..... 439/67, 77, 131, 297, 439/374, 377

[56] References Cited

U.S. PATENT DOCUMENTS 4,482,938 11/1984 Norden ..... 439/43
4,653,823 3/1987 Burson et al. ..... 439/77
4,710,136 12/1987 Suzuki ..... 439/297

FOREIGN PATENT DOCUMENTS 1927255 4/1965 Fed. Rep. of Germany .
2441670 3/1976 Fed. Rep. of Germany .
2806236 9/1978 Fed. Rep. of Germany .
2701703 11/1978 Fed. Rep. of Germany .

OTHER PUBLICATIONS

Siemens & Halske Aktiengesellschaft 65/2253–Apr. 14, 1965.

*Primary Examiner*—P. Austin Bradley
*Attorney, Agent, or Firm*—David R. Treacy

[57] ABSTRACT

Electrical interconnections between two assemblies, whose connectors are located in hard-to-access areas of an apparatus, are easily connected or disconnected by mounting one of the connectors on a holder which is movable on a support. A first connector is electrically connected to components of a first assembly by flexible leads, and is mounted mechanically on a holder which is detachably aligned on a support fixed on that first assembly. In an initial position, the first assembly's connector is fixed in a position which allows easy access by a test device for electrical connection to the connector. To interconnect the two assemblies in the apparatus, the first assembly is mechanically mounted in its final position, with its connector arranged approximately in line with the mating connector of the second assembly. The holder, which has a long handle or grip providing easy access from the exterior of the apparatus, is then moved along the support toward the second connector. After a small movement, guides on the holder disengage from the support, and the holder and connector are then aligned by a funnel providing self-alignment between the two connector portions before they engage in final electrical connection. Repair or disassembly are simplified because a reverse pull on the holder releases electrical connection between the assemblies, and then fixes the first assembly's connector to its support.

20 Claims, 3 Drawing Sheets

DEVICE FOR ELECTRICALLY INTERCONNECTING ELECTRICAL AND/OR ELECTROMECHANICAL ASSEMBLIES, METHOD OF ELECTRICALLY INTERCONNECTING SUCH ASSEMBLIES, AND APPARATUS MANUFACTURED IN ACCORDANCE WITH THE METHOD

BACKGROUND OF THE INVENTION

The invention relates to a device for electrically interconnecting electrical and/or electromechanical assemblies in housings of electrical apparatuses, such as car radios, video or audio recorders and data terminal equipment such as printers, preferably at hard-to-access areas of contact between these assemblies. Such a device typically includes connector elements on a first assembly and on a second assembly, the connector element of the first assembly being connected to components of the first assembly by flexible electrical leads. The invention also relates to a method of electrically interconnecting such assemblies by means of the device, and to an apparatus manufactured in accordance with the method.

Such a device is known in car-radio cassette-players. However, in the case of hard-to-access contact locations inside the housing of an electrical apparatus the problem is that establishing contact at the hard-to-access locations is time-consuming and labor intensive. Interconnection becomes very difficult if, during subsequent repairs, the contacts at the hard-to-access locations have to be disengaged and re-engaged. This applies in particular to apparatus of very compact construction, such as car-radio cassette-players. As the manufacture of these apparatuses is automated to an increasing extent, making electrical interconnections at inaccessible locations causes a disproportionate rise in costs.

From DE-OS 3,301,568 it is known to interconnect two assemblies by connector elements, correct engagement of the connector elements being guaranteed by means of guide elements. The guide elements may be arranged on a frame.

SUMMARY OF THE INVENTION

An object of the invention is to provide a device and method which simplify electrical interconnection of assemblies inside the housing of an apparatus of compact construction.

Another object of the invention is to facilitate repair of a compact apparatus having electrical interconnections inside a housing.

According to the invention these objects are achieved in that the connector element of the first assembly is arranged on a holder which extends into a more conveniently accessible area of the housing, and this holder can be detachably clamped onto a support of the first assembly in such a way when the holder is pressed down and released from the support, the connector element is engageable with the connector element of the second assembly.

Thus, when the assembly is mounted inside a housing, interconnection at very inaccessible locations is possible without any special dexterity. In addition, interconnection is also possible by means of machines, such as robots, which simply press the holders in place, the first and the second assembly being interconnected by the robot by downward pressure alone without any special guidance, because the connector elements of the first assembly are caught by the connector elements of the second assembly. Since the holders are released before being caught, mutual tolerances of the assemblies inside the housing can be readily compensated for.

In a further embodiment of the invention the support is provided with guides which extend in the direction of pressing down, and the holder has grooves which engage the guides when the holder is slid onto the support.

In another embodiment the holder is provided with guides which extend in the direction of pressing down, the support has grooves, and the holder guides engage the grooves when it is slid onto the support. During pre-assembly this enables the holders to be brought into the predetermined positions, and during subsequent repairs it enables the holders to be pulled out of engagement into the predetermined initial positions. The grooves and the guides then always cooperate with one another in the appropriate manner.

In a further embodiment of the invention the holder, when slid onto the support, is detachably clamped or latched onto the support. During pre-assembly this clamping or latching ensures that the holders are always retained in their predetermined initial positions for pressing down. This is also advantageous during subsequent repairs because the pulled-up holders do not lie loose but are held in position.

In a further embodiment of the invention the guides and the grooves cooperate with each other over such a length in the direction of pressing down, that the holder is released from the support shortly after pressing down has begun. Thus, immediately after pressing down, the holder has enough freedom of movement to align with the connector element of the second assembly.

In a further embodiment of the invention a portion of the holder also functions as a grip for a tool and for manipulation by hand. Such a grip construction is particularly convienient for repair purposes, but also facilitates the use of robots.

In a further embodiment of the invention the housing of a connector element of one of the assemblies has an insertion funnel for the connector element of the other assembly. This insertion funnel ensures that the connector element of the first assembly correctly engages the connector element of the second assembly. This enables mutual tolerances between the assemblies in the housing to be compensated for even more effectively and easily.

It is customary and also advantageous if the individual assemblies before they are combined with other assemblies are separately tested for their correct operation. This testing is effected by means of test devices provided with suitable contacts for testing. For this purpose, in a preferred embodiment of the invention, the connector element of the first assembly is in such a position when the holder is in the clamped or latched condition, that the element is engageable with contacts of the test device when the first assembly is placed on the test device. If the contacts of the test device are arranged in such a way that, when the first assembly is placed on the test device the test device contacts are engageable with the holders which are clamped or latched in the supports, testing can be effected rapidly and no special operations are needed to connect the connector elements of the first assembly to the connector elements of the test device. A reliable interconnection is established by simply placing the assembly in position.

In a further embodiment of the invention the holder comprises a strain-relief edge for the flexible leads. The flexible lead connections, which are suitably constituted by flat flexible cables, are thus attached to the holder in such a way that they cannot be damaged during pressing down.

Interconnection by means of the device in accordance with the invention is effected by a method in which the first assembly is brought into a predetermined position relative to the second assembly; the holder, whose connector element is then positioned above the connector element of the second assembly, is pressed off the support towards the connector element of the second assembly; the holder with the connector element is disengaged from the support when the holder is pressed down; and the connector element of the first assembly is caught in its path of free movement and is guided to engage with the connector element of the second assembly. Such a method is particularly suitable for mass production and is very economic.

An apparatus manufactured in accordance with this method is characterized in that at least a part of a wall of the housing is removable to forming an opening in the housing, the support of the first assembly positioning the grip on the holder relative to the opening and relative to the other assemblies in such a way that the grip is accessible and can be manipulated from the exterior through the opening. Although the connector contacts for the interconnection of the assemblies are situated at an inaccessible location on the bottom of duetlike recesses, interconnection and disconnection is possible without any problems. Thus, the assemblies can be arranged very close to one another, without interconnection problems during assembling.

Embodiments of the invention will be described in more detail, by way of example, with reference to the accompanying drawing.

DESCRIPTION OF THE PREFERRED EMBODIMENTS

Figure 1:
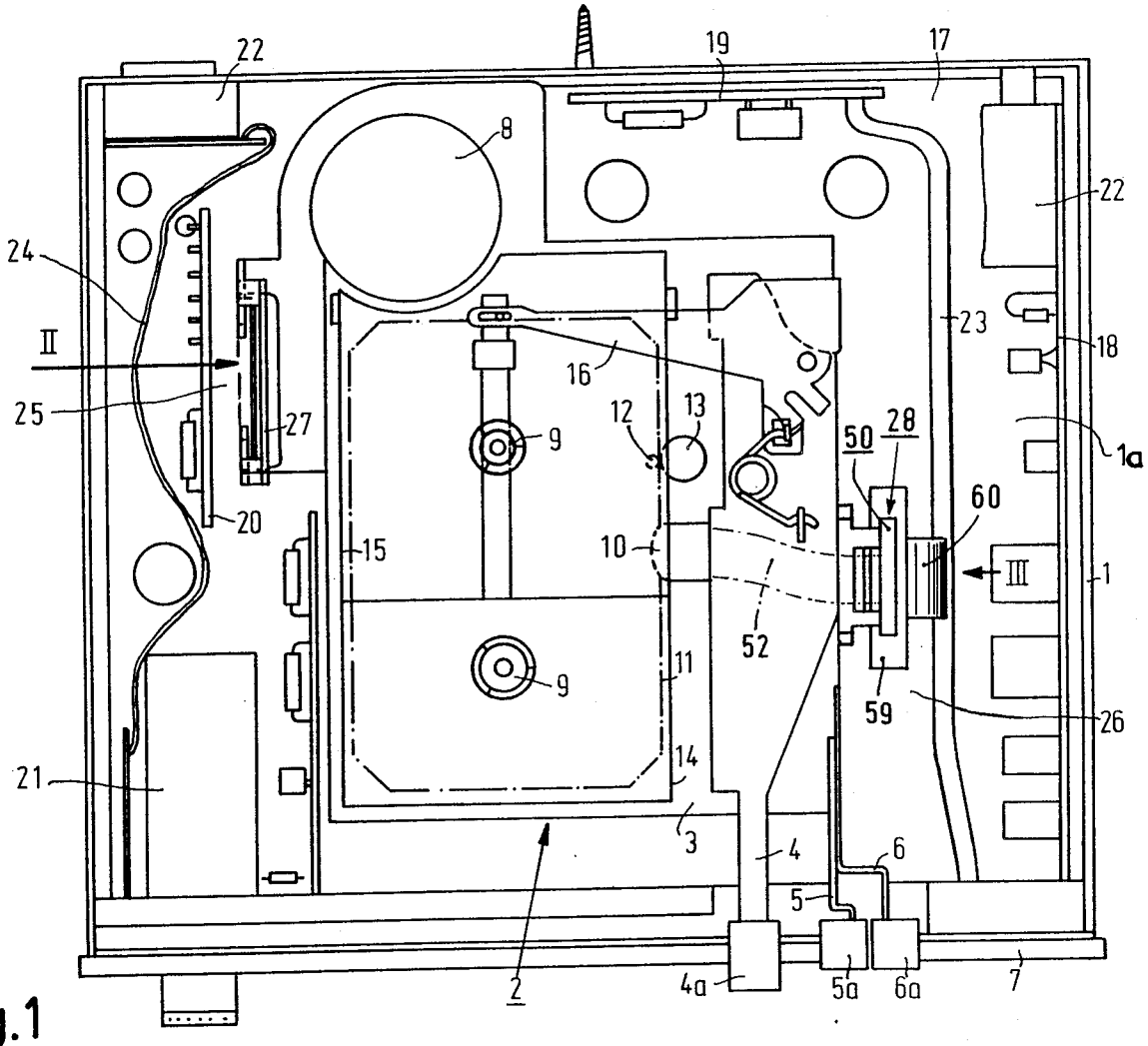
FIG. 1 is a plan view of a car radio comprising a number of assemblies, in the assembled condition, the cover being removed from the apparatus housing.

An electrical apparatus in accordance with the invention, which may be a car radio, a video or audio recorder, or data terminal equipment, but also any other apparatus, is shown in FIG. 1, which by way of example shows a car radio/cassette player. The invention is applied in such apparatus where it is essential that an electrical or electromechanical assembly must be interconnected to one or more electrical or electromechanical assemblies, the contact locations being situated in hard-to-access areas inside the apparatus.

In the case of the radio/cassette player shown in FIG. 1 a number of assemblies are arranged inside a housing 1 constructed as a cabinet. Upon removal of the upper cover the interior of the housing is accessible from the top through an opening 1*a* for mounting the assemblies. A first assembly 2 is secured to the bottom of the housing and is the deck of the cassette player. This tape deck, which is described in DE-OS 33 12 136 to which U.S. Pat. No. 4,623,945, corresponds comprises a chassis 3 relative to which three push-button rods 4, 5, 6 are movable. The rods 4, 5, 6 extend through the front plate 7 of the housing 1 and can be actuated from the outside by means of respective push-buttons 4*a*, 5*a*, 6*a*.

The deck also includes a motor 8 for driving winding spindles 9 and a capstan 12, and a magnetic head 10 by means of which a magnetic tape, not shown, arranged in a Compact Cassette 11 can be scanned. A pressure roller 13 can be pressed against the capstan 12 for the magnetic tape. The Compact Cassette 11 can be inserted into a lift 14 and can be lowered onto the winding spindles 9 by means of the lift. The lift 14 is controlled by means of a lift lever 15, which is visible in FIG. 2. The lift lever 15 is controlled by a member 16 which is actuated by the push-button rod 4.

As already stated, several other assemblies such as a second assembly 17, a third assembly 18, a fourth assembly 19, a fifth assembly 20, a switch 21 and connection means 22 are arranged inside the housing 1. Cable connections, for example a cable connection 23 and a cable connection 24, extend between the individual assemblies. Ducts 25 and 26 are formed between the first assembly 2 and the other assemblies. The electrical interconnections between the second assembly 17 and the first assembly 2 should be made at the bottoms of these ducts.

The first assembly is mechanically secured to the bottom of the housing 1. This may cause a tolerance build up which makes it impossible to provide a direct rigid interconnection between the contacts associated with the second assembly 17, and the contacts of the first assembly 2 which are connected to the chassis 3. These tolerances occur because the two assemblies are connected to the housing 1 independently of one another and the assemblies themselves exhibit tolerances independently of one another. These tolerances may accumulate and become so large that direct electrical interconnection of contacts which are rigidly connected to the assemblies is not possible in mass-production.

In order to overcome this problem of tolerance build up, the apparatus is provided with special devices for electrical interconnection. In FIG. 1 such a first device bears the reference numeral 27 and a second device bears the reference numeral 28. The first device is shown to an enlarged scale in FIG. 2 and the second device 28 is shown to an enlarged scale in FIG. 3 with their connector elements in the initial positions prior to release and prior to the electrical interconnections being made.

The device 27 comprises a support 29, which is rigidly connected to the chassis 3. Alternatively, the support 29 may be formed by a portion of the chassis. The support 29 is situated near the motor 8 and extends perpendicularly to the second assembly 17. This second assembly is an electrical circuit board which is densely packed with components. The support 29 has guides 30 which bound two facing edges of a hole 31 in the center of the support 29. The guides 30 extend substantially perpendicularly to the second assembly 17. The support comprises two latching projections 32 which adjoin the guides 30 and point towards each other into the hole 31.

Figure 2:
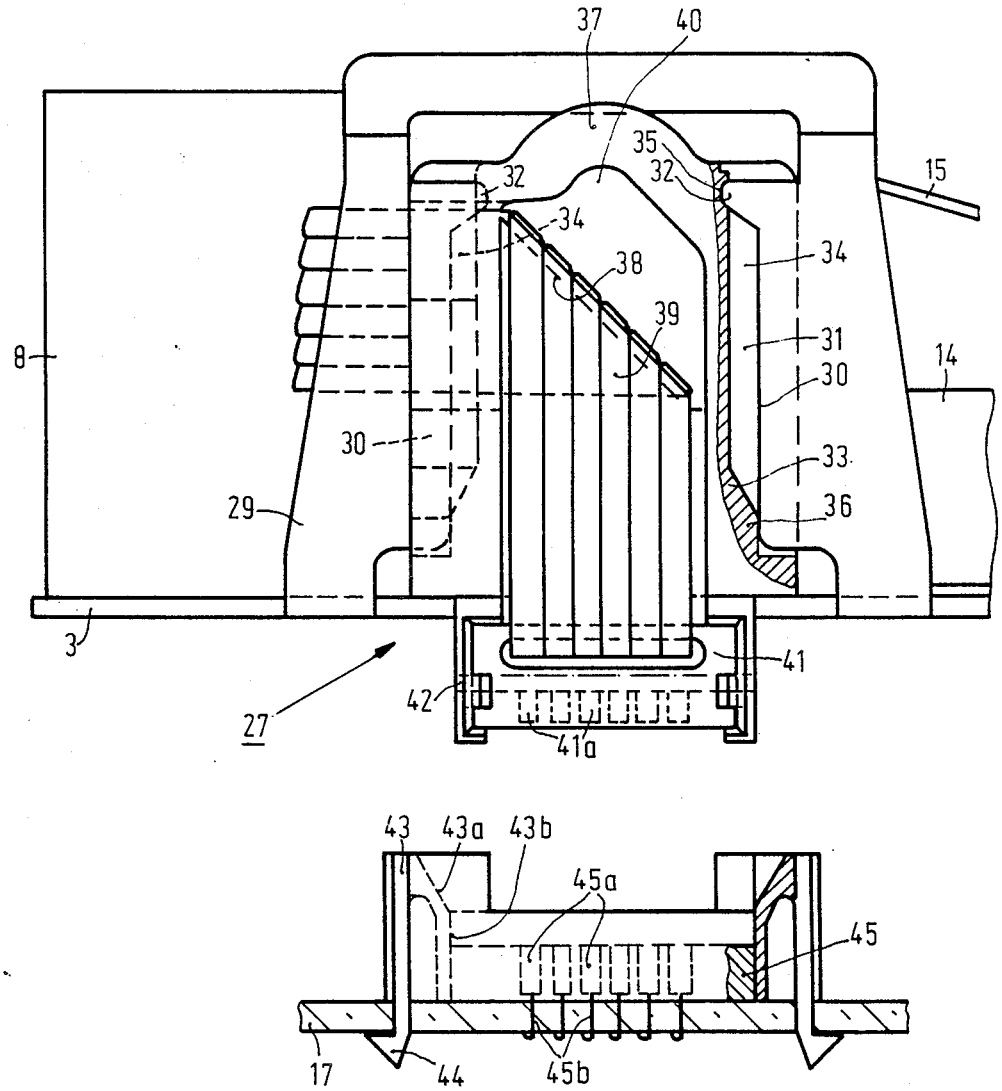
FIG. 2 shows a first assembly and a part of a second assembly in an enlarged-scale view taken on the line II in FIG. 1.
Figure 4:
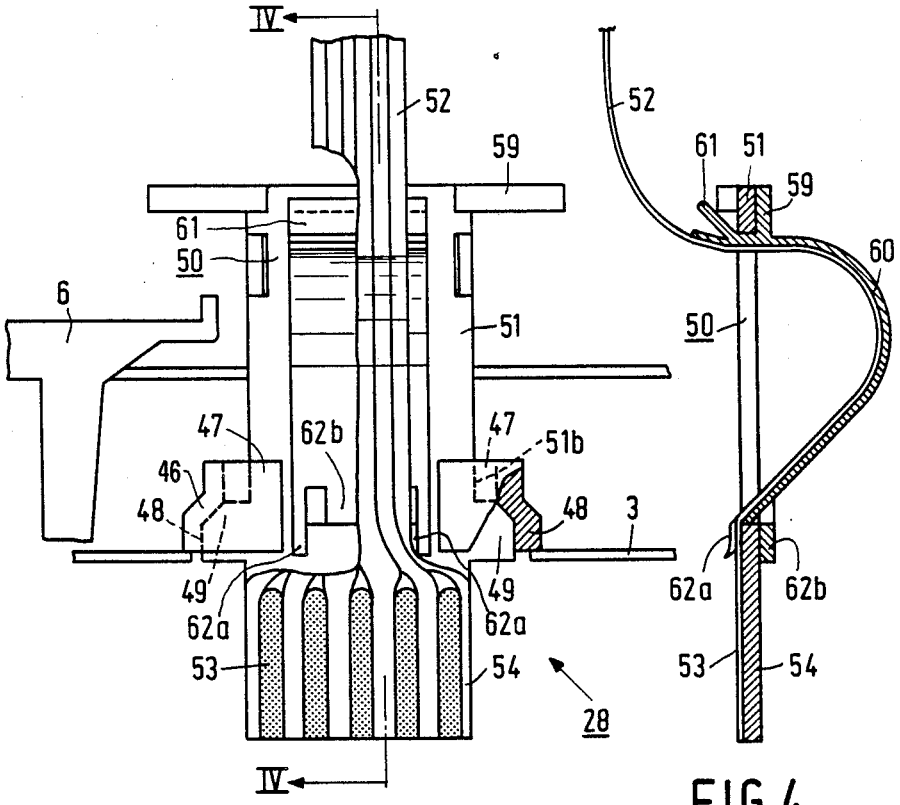
FIG. 4 shows a holder with a stop and a protection element for the flat flexible cable in a view taken on the line IV—IV in FIG. 3.
Figure 3:
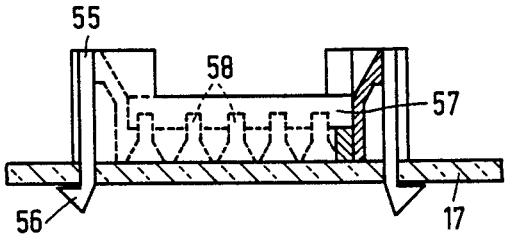
FIG. 3 shows a part of the first assembly and the second assembly in an enlarged-scale view taken on the line III in FIG. 1.

A holder 33 can be slid onto the support 29 from the chassis 3 by the second assembly 17. The holder 33 is preferably a part made of a plastic and is provided with two U-shaped grooves 34 which extend substantially parallel to the guides 30. The grooves 34 have recesses 35 which are engaged by the latching projections 32 when the holder 33 is fully inserted into the hole 31 of the first assembly 2 as shown in FIG. 2. If the holder 33 is fully inserted as shown in FIG. 2, projecting initial-position-alignment edges 36 provided on the groove bottom are squeezed by the initial guides 30. Thus, in the fully inserted condition shown in FIG. 2 the holder 33 is unambiguously positioned and retained on the support 29.

In the situation shown in FIG. 2 the holder 33 is provided with a grip 37 at its upper edge portion, which grip after subsequent mounting can be gripped by hand or by a tool through the opening 1*a*. Inside the holder 33 a strain-relief edge 38 is provided over which a flat flexible lead 39 is pulled. An opening 40 between the strain-relief edge 38 and the grip 37 allows the passage of the lead 39. The lead is connected to a connector element 41 provided with connector pins 41*a*. The connector element 41 is connected to the holder 33 by means of clip 42.

The second assembly 17 is provided with an insertion funnel 43 which is clamped onto the second assembly 17 by means of clamping projections 44. This insertion funnel contains another connector element 45 provided with connector sockets 45*a*. Connecting leads 45*b* connect the connector sockets to leads, not shown, of the second assembly 17.

When as is shown in the upper portion of FIG. 2, the holder 33 occupies a latched initial position on the support 29, the first assembly 2 can be mounted on a test device for testing the correct operation of the first assembly. When the first assembly 2 is fitted to the test device the connector pins 41*a* engage associated contact sockets of the test device, not shown. After testing, the first assembly is mounted in the housing 1 and is subsequently mechanically connected to the housing 1 in a manner, not shown. The second assembly 17 will have been mounted in the housing prior to this.

As the first assembly is being mounted in the housing after the second assembly, the connector element 41 will be situated above the insertion funnel 43 which is situated deep in the duct 25. When the first assembly 2 is first secured in the housing 1, the electrical interconnection is not yet made. This interconnection is not made until the holder 33 is pressed down towards the insertion funnel 43. During pressing down the holder 33 is released from the support 29 when the alignment edges 36 move clear of the guides 30. Immediately after its release the holder 33 has a certain freedom of movement inside the guides 30, which movement is limited by the grooves 34. This limited guidance is important in order to ensure that the holder 33 with the connector element 41 is always engageable by the inclined guide edges 43*a* of the insertion funnel 43. The inclined edges 43*a* adjoin straight guide edges 43*b*, which ensure that the inserted connector element 41 will become aligned with the connector element 45, so that the connector pins 41*a* properly contact the connector sockets 45*a*.

The advantage of this construction resides not only in the reliable interconnection at the bottom of the duct 25 and the compensation for manufacturing tolerances. Another advantage is that in the event of repairs the holder 33 can be pulled up by hand by the grip 37, allowing ready disengagement. During pulling up latching is restored. The guides 30 again ensure a correct movement. The small width of the duct 25 presents no problem with respect to disengagement. In this way repairs can be carried out more rapidly. The device 27 enables both engagement and disengagement to be effected without any problems. This method of mounting is very suitable for mass production, in particular when robots are used.

The device 27 serves, for example, for connection of the motor 8, thus enabling the tape-deck functions of the first assembly 2 to be controlled via the second assembly 17.

As already stated, there is provided a second device 28 by means of which a further interconnection can be made. This interconnection serves for the electrical connection of the magnetic head 10 to the second assembly 17. In principle, the second device 28 operates in the same way as the first device 27. The device 28 comprises a support 46 which is rigidly connected to the chassis 3. The support 46 has grooves 47 which face each other. At the groove bottom the grooves 47 have recesses 48 which are engageable by latching projections 49 of a holder 50. The holder comprises a rectangular frame 51. A flat flexible cable 52 arranged on the holder 50 is electrically connected to connector tracks 53 which together with the holder 50 constitute a connector element 54. The edges 51*b* of the frame 51 constitute guides engaging the grooves 47.

The second assembly 17 again has an insertion funnel 55 which is clamped onto the second assembly 17 by means of a clip 56. In principle, the insertion funnel 55 corresponds to the insertion funnel 43 of FIG. 2. A connector element 57 comprising contact springs 58 is arranged in the funnel. After mechanical connection of the first assembly 2 in the housing 1 the connector element 54 is engageable with the connector element 57 by lowering the holder 50 in the same way as in the first device 27. In the same way the funnel 55 compensates for tolerances between the assemblies. The operating principle is identical to that described with reference to FIG. 2, the device 28 again enabling testing to be carried out when the holder 50 is fitted, an interconnection to be made with the holder 50 pressed down, and a repair to be carried out by pulling up and subsequently lowering the holder 50. The holder 50 is provided with a plastic part comprising a stop 59 which extends parallel to the upper side of the holder 50 and projects at two sides, so that the holder 50 is lifted out of the connector element 57 if during removal of the assembly 2 the upper side of the support 46 abuts against the stop 59. The plastics part is provided with a curved protective bracket 60, which protects the flat flexible electric cable 52. The protective bracket 60 extends from the stop 59 to the proximity of the connector tracks 53. The protective bracket is clamped onto the frame 51 by means of clamping portions 61 and 62*a*, 62*b*. The clamping portions 61, 62*a* and 62*b* are integral with the protective bracket 60.

What is claimed is:

1. A device for electrically interconnecting assemblies in a housing of an electrical apparatus, comprising:

a first assembly including a plurality of electrical components and a first connector element connected thereto by flexible electrical leads, and a second assembly including a second connector element disposed thereon, at least said first connector element being disposed in a hard-to-access area within said housing, characterized in that said first assembly further comprises:

a holder on which said first connector element is arranged, said holder extending into a conveniently accessible area of said housing, a support, and means for detachably aligning said holder to said support in an initial relative position, and means for detaching said holder from said support by pressing said holder in a given direction, in response to relative movement of said holder in said given direction said holder being released from the support and said first connector element then engaging electrically with said second connector element.

2. A device as claimed in claim 1, characterized in that said holder comprises a portion formed as a grip for engagement by a tool and for manipulation by hand.

3. A device as claimed in claim 2, characterized in that said first connector element is so arranged, when in said initial position, that it is engageable with contacts of a test device when the first assembly is placed on the test device.

4. A device as claimed in claim 1, characterized in that the device comprises a set of guides and grooves extending in said given direction, said means for detachably aligning being a portion of said set, in said initial position said guides engaging said grooves to align the holder to the support.

5. A device as claimed in claim 4, characterized in that at least one of said guides is squeezed in one of said grooves while the holder is in said initial position, and in response to relative movement of said holder in said given direction said one of said guides is no longer squeezed in said one of said grooves, said holder then being free for limited movement with respect to said support in a direction transverse to said given direction.

6. A device as claimed in claim 5, characterized in that the guides and grooves cooperate with each other over such a length in said given direction that the holder is released from the support shortly after pressing has begun.

7. A device as claimed in claim 6, characterized in that one of said connector elements includes a housing having an insertion funnel for the other connector element.

8. A device as claimed in claim 6, characterized in that said holder comprises a portion formed as a grip for engagement by a tool and for manipulation by hand.

9. A device as claimed in claim 8, characterized in that said first connector element is so arranged, when in said initial position, that it is engageable with contacts of a test device when the first assembly is placed on the test device.

10. A device as claimed in claim 9, characterized in that said holder comprises a strain relief for said flexible leads, and a stop which abuts against the support when the holder is in the initial position.

11. A device for electrically interconnecting assemblies in a housing of an electrical apparatus, comprising:

a first assembly including a plurality of electrical components and a first connector element connected thereto by flexible electrical leads, and a second assembly including a second connector element disposed thereon, at least said first connector element being disposed in a hard-to-access area within said housing, characterized in that said first assembly further comprises:

a holder on which said first connector element is arranged, said holder extending into a conveniently accessible area of said housing, a support, and means for detachably aligning said holder to said support in an initial relative position, means for latching said holder to said support with respect to relative movement in a given direction, and means for unlatching and detaching said holder from said support by pressing said holder in said given direction, in response to relative movement of said holder in said given direction said holder being released from the support and said first connector element then engaging electrically with said second connector element.

12. A device as claimed in claim 11, characterized in that the device comprises a set of guides and grooves extending in said given direction, said means for detachably aligning being a portion of said set, in said initial position said guides engaging said grooves to align the holder to the support.

13. A device as claimed in claim 12, characterized in that at least one of said guides is squeezed in one of said grooves while the holder is in said initial position, and in response to relative movement of said holder in said given direction said one of said guides is no longer squeezed in said one of said grooves, said holder then being free for limited movement with respect to said support in a direction transverse to said given direction.

14. A device as claimed in claim 13, characterized in that the guides and grooves cooperate with each other over such a length in said given direction that the holder is released from the support shortly after pressing has begun.

15. A device as claimed in claim 14, characterized in that one of said connector elements includes a housing having an insertion funnel for the other connector element.

16. A device as claimed in claim 14, characterized in that said holder comprises a portion formed as a grip for engagement by a tool and for manipulation by hand.

17. A device as claimed in claim 16, characterized in that said first connector element is so arranged, when in said initial position, that it is engageable with contacts of a test device when the first assembly is placed on the test device.

18. A device as claimed in claim 17, characterized in that said holder comprises a strain relief for said flexible leads, and a stop which abuts against the support when the holder is in the initial position.

19. A method of electrically interconnecting assemblies in a housing of an electrical apparatus by means of a device comprising:

a first assembly including a plurality of electrical components and a first connector element connected thereto by flexible electrical leads, and a second assembly including a second connector element disposed thereon, at least said first connector element being disposed in a hard-to-access area within said housing, characterized in that said first assembly further comprises:

a holder on which said first connector element is arranged, said holder extending into a conveniently accessible area of said housing, a support, and means for detachably aligning said holder to said support in an initial relative position, and means for detaching said holder from said support by pressing said holder in a given direction, in response to relative movement of said holder in said given direction said holder being released from the support and said first connector element then engaging electrically with said second connector element, and wherein the method comprises the steps of bringing the first assembly into a predetermined position with respect to the second assembly with said first connector element being positioned above said second connector element, then pressing said holder toward the second connector element so as to release the holder from the support, and continuing to press the holder through a path of free movement toward the second connector element until the connector elements are electrically interconnected.

20. An apparatus manufactured according to the method of claim 19, comprising a housing having a wall with a removable part, removal of the part leaving an opening in the housing, characterized in that said support positions said grip relative to the opening such that the grip is accessible and can be manipulated from the exterior of the apparatus through the opening.

* * * * *